US009488126B2

(12) United States Patent
Bischofberger et al.

(10) Patent No.: US 9,488,126 B2
(45) Date of Patent: Nov. 8, 2016

(54) METHOD FOR PRODUCING A CYLINDER LINER SURFACE AND CYLINDER LINER

(75) Inventors: Ulrich Bischofberger, Esslingen (DE); Stefan Gaiselmann, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 14/130,514

(22) PCT Filed: Jul. 4, 2012

(86) PCT No.: PCT/DE2012/000668
§ 371 (c)(1),
(2), (4) Date: Jan. 28, 2014

(87) PCT Pub. No.: WO2013/004213
PCT Pub. Date: Jan. 10, 2013

(65) Prior Publication Data

US 2014/0144404 A1 May 29, 2014

(30) Foreign Application Priority Data

Jul. 5, 2011 (DE) ..... 10 2011 106 564

(51) Int. Cl.

| | |
|---|---|
| ***F02F 1/00*** | (2006.01) |
| ***C23C 4/02*** | (2006.01) |
| ***C23C 4/08*** | (2016.01) |
| ***C23C 4/18*** | (2006.01) |
| ***C23C 24/04*** | (2006.01) |
| ***C23C 26/00*** | (2006.01) |
| ***F02F 1/20*** | (2006.01) |

(52) U.S. Cl.
CPC ..... *F02F 1/004* (2013.01); *C23C 4/02* (2013.01); *C23C 4/08* (2013.01); *C23C 4/18* (2013.01); *C23C 24/04* (2013.01); *C23C 26/00* (2013.01); *F02F 1/20* (2013.01)

(58) Field of Classification Search
CPC ..... C23C 24/04; C23C 4/02; C23C 4/08; C23C 4/18; C23C 4/04; F02F 1/004; F02F 1/20; F02F 1/24; C10M 103/04; C10M 2201/003; B22D 19/0009; B22D 19/08; F02B 77/02
USPC ..... 123/193.2, 270, 272
See application file for complete search history.

(56) References Cited

U.S. PATENT DOCUMENTS

| | | | | |
|---|---|---|---|---|
| 2,292,662 | A * | 8/1942 | Sanders | 92/169.1 |
| 3,165,983 | A * | 1/1965 | Thomas | 92/169.1 |
| 3,435,502 | A * | 4/1969 | Morgan et al. | 29/888.074 |
| 3,620,137 | A * | 11/1971 | Prasse | 92/159 |
| 3,720,510 | A * | 3/1973 | Isobe et al. | 420/516 |
| 3,808,955 | A * | 5/1974 | Hamada et al. | 92/169.1 |
| 4,260,658 | A * | 4/1981 | Erickson | 428/163 |
| 4,676,877 | A * | 6/1987 | Castillo et al. | 205/74 |
| 4,774,393 | A | 9/1988 | Tarumoto et al. | |
| 5,149,937 | A | 9/1992 | Babel et al. | |
| 5,179,994 | A * | 1/1993 | Kuhn | 164/100 |
| 5,183,025 | A * | 2/1993 | Jorstad et al. | 123/669 |
| 5,333,668 | A * | 8/1994 | Jorstad et al. | 164/100 |
| 5,363,821 | A * | 11/1994 | Rao et al. | 123/193.2 |
| 5,549,086 | A * | 8/1996 | Ozawa et al. | 123/193.6 |
| 5,655,955 | A * | 8/1997 | Nagel et al. | 451/124 |
| 5,879,816 | A * | 3/1999 | Mori et al. | 428/621 |
| 6,622,685 | B2 * | 9/2003 | Takahashi et al. | 123/193.2 |
| 6,634,179 | B2 | 10/2003 | Heinemann et al. | |
| 7,279,227 | B2 * | 10/2007 | Obara | 428/546 |
| 7,438,038 | B2 * | 10/2008 | Azevedo et al. | 123/193.2 |
| 7,513,236 | B2 * | 4/2009 | Miyamoto et al. | 123/193.2 |
| 8,492,318 | B2 | 7/2013 | Barbezat et al. | |
| 8,667,945 | B2 * | 3/2014 | Sasaki | 123/193.6 |
| 8,869,737 | B2 | 10/2014 | Takahashi et al. | |
| 2001/0013401 | A1 * | 8/2001 | Fukai et al. | 164/100 |
| 2002/0025386 | A1 | 2/2002 | Heinemann et al. | |
| 2004/0023078 | A1 * | 2/2004 | Rosenflanz | C03C 3/062 428/702 |
| 2005/0191099 | A1 * | 9/2005 | Yamaguchi et al. | 399/346 |
| 2005/0235944 | A1 * | 10/2005 | Michioka | 123/193.2 |
| 2007/0009669 | A1 * | 1/2007 | Miyamoto et al. | 427/446 |
| 2007/0116886 | A1 * | 5/2007 | Refke | C23C 4/085 427/446 |
| 2007/0143996 | A1 | 6/2007 | Michioka | |
| 2009/0246384 | A1 * | 10/2009 | Liao et al. | 427/282 |
| 2009/0258140 | A1 | 10/2009 | Bucher | |

(Continued)

FOREIGN PATENT DOCUMENTS

| | | |
|---|---|---|
| CN | 1340110 A | 3/2002 |
| CN | 1341156 A | 3/2002 |
| CN | 101939462 A | 1/2011 |

(Continued)

OTHER PUBLICATIONS

International Search Report of PCT/DE2012/000668, mailed Dec. 6, 2012.

(Continued)

*Primary Examiner* — Marguerite McMahon
*Assistant Examiner* — Tea Holbrook
(74) *Attorney, Agent, or Firm* — Collard & Roe, P.C

(57) ABSTRACT

A method for producing a cylinder liner surface for a cylinder crankcase of an internal combustion engine has the following method steps: (a) preliminary honing of the inner surface of a cylinder liner consisting of a cast iron material to form depressions in the surface; (b) application of a coating material containing zinc to the honed surface; (c) final honing of the coated surface in such a way that the coating material containing zinc remains only in the depressions formed by the preliminary honing.

11 Claims, No Drawings

(56) References Cited

U.S. PATENT DOCUMENTS

| | | | |
|---|---|---|---|
| 2009/0305917 | A1 | 12/2009 | Tanizawa et al. |
| 2011/0142384 | A1 | 6/2011 | Hofmann |

FOREIGN PATENT DOCUMENTS

| | | | | |
|---|---|---|---|---|
| DE | 28 24 770 | A1 | 12/1979 | |
| DE | 38 13 617 | C1 | 10/1989 | |
| DE | 695 23 215 | T2 | 4/2002 | |
| DE | 10334701 | A1 * | 2/2005 | ..... F02F 1/00 |
| DE | 10 2008 053 642 | A1 | 5/2010 | |
| EP | 0 040 054 | A1 | 11/1981 | |
| EP | 0 690 250 | A1 | 1/1996 | |
| EP | 1 589 212 | A1 | 10/2005 | |
| GB | 2 361 759 | A | 10/2001 | |
| GB | 2 361 982 | A | 11/2001 | |
| JP | S61-144469 | A | 7/1986 | |
| JP | S61-166962 | A | 7/1986 | |
| JP | S62-192534 | A | 8/1987 | |
| JP | S62-253779 | A | 11/1987 | |
| JP | S62-256960 | A | 11/1987 | |
| JP | H02-294423 | A | 12/1990 | |
| JP | H07-83109 | A | 3/1995 | |
| JP | H08-21297 | | 1/1996 | |
| JP | 2002-534634 | A | 10/2002 | |
| JP | 2002-534635 | A | 10/2002 | |
| JP | 2005-307857 | A | 11/2005 | |
| JP | 2007-278090 | A | 10/2007 | |
| JP | 2007-284706 | A | 11/2007 | |
| JP | 2007-285312 | A | 11/2007 | |
| JP | 2009-507159 | A | 2/2009 | |
| JP | 2010-255846 | A | 11/2010 | |
| JP | 2010-255847 | A | 11/2010 | |
| JP | 2011-117079 | A | 6/2011 | |
| JP | 2012-500365 | A | 1/2012 | |
| WO | WO 9831850 | A1 * | 7/1998 | ..... C23C 28/00 |
| WO | 00/49328 | A1 | 8/2000 | |

OTHER PUBLICATIONS

German Search Report dated Feb. 20, 2012 in German Application No. 10 2011 106 564.8 with English translation.

Japanese Office Action dated Mar. 22, 2016 in Japanese Application No. 2014-517452.

English translation of Chinese Office Action issued Dec. 16, 2014 in Chinese Application No. 201280033530.5.

Japanese Office Action dated Mar. 22, 2016 in Japanese Application No. 2014-517452 with English translation.

Japanese Office Action dated Aug. 1, 2016 in Japanese Application No. 2014-517452 with English translation.

* cited by examiner

METHOD FOR PRODUCING A CYLINDER LINER SURFACE AND CYLINDER LINER

CROSS REFERENCE TO RELATED APPLICATIONS

This application is the National Stage of PCT/DE2012/000668 filed on Jul. 4, 2012, which claims priority under 35 U.S.C. §119 of German Application No. 10 2011 106 564.8 filed on Jul. 5, 2011, the disclosures of which are incorporated by reference. The international application under PCT article 21(2) was not published in English.

The present invention relates to a method for the production of a cylinder working surface and to a cylinder liner for a cylinder crankcase of an internal combustion engine.

Cylinder liners are generally produced from a steel material or a cast-iron material. Cylinder liners composed of a cast-iron material are, however, susceptible to corrosion. It is true that it is known to provide the working surfaces of cylinder liners with a corrosion-resistant and abrasion-resistant coating galvanically, for example on the basis of chromium. However, this has a disadvantageous effect on the material costs and on the costs of the production method.

The present invention is therefore based on the task of increasing the corrosion resistance of cylinder liners composed of a cast-iron material. Furthermore, the material—production costs are supposed to be reduced.

The solution consists in a method having the following method steps: (a) pre-honing of the inner surface of a cylinder liner composed of a cast-iron material, with the formation of depressions in the surface; (b) application of a zinc-containing coating material onto the pre-honed surface; (c) finish-honing of the coated surface, in such a manner that the zinc-containing coating material remains only in the depressions formed by means of the pre-honing.

Furthermore, a cylinder liner that can be produced according to the method according to the invention, composed of a cast-iron material, for a cylinder crankcase, is an object of the present invention.

The method according to the invention is characterized in that the protective effect against corrosive attack is achieved by means of a cathodic protective effect. During the corrosion process, zinc is first oxidized in place of the iron contained in the cast-iron material. Only after the zinc contained in the coating has been completely oxidized can a corrosive attack on the iron be observed. In the end result, corrosive damage to the cast-iron material is significantly delayed, and the useful lifetime of the cylinder liner treated according to the invention is significantly increased.

Using the method according to the invention, a coating on the inner surface of the cylinder liner is obtained, in which the zinc-containing coating material remains only in the depressions that were introduced into the surface by means of the pre-honing. Thus, effective corrosion protection is achieved with very little expenditure of coating material.

Advantageous further developments are evident from the dependent claims.

It is practical if the pre-honed surface is coated with a zinc film in step (b), i.e. provided with the zinc-containing coating without any heat effect.

Suitable zinc-containing coating materials for use in step (b) are, in particular, zinc varnishes on an inorganic basis, for example water-based inorganic zinc silicates with zinc powder, which contain at least 92 wt.-% zinc. These zinc varnishes are temperature-resistant up to 600° C. A typical product available on the market is the zinc varnish "Aquazinga" from the Zinga company, Germany.

Preferably, in step (b), the zinc-containing coating is applied by means of a scraping method, in order to guarantee that the depressions introduced into the surface by means of the pre-honing are filled with the coating material as completely as possible.

However, in step (b), the coating material can also be applied by means of thermal spraying, by means of cold-gas spraying, or by means of vacuum suction blasting, using a zinc-containing wire or a zinc-containing powder.

A particularly preferred embodiment of the method according to the invention consists in that after the pre-honing and before the application of the zinc-containing material, pocket-shaped depressions are introduced into the pre-honed surface. Such depressions or "pockets" bring about the result that after finish-honing, a greater amount of zinc-containing coating agent remains on the finished working surface of the cylinder liner, because the zinc-containing coating agent remains not only in the depressions introduced into the surface by means of the pre-honing, but also in the pocket-shaped depressions introduced into the surface subsequent to the pre-honing.

It is practical if the pocket-shaped depressions are introduced into the surface with a maximal depth of 100 μm and/or with a diameter of 30 μm to 50 μm, in order to allow a uniform distribution on the surface.

Preferably, the pocket-shaped depressions are introduced into the surface with an area proportion of 2% to 10%. In this way, an optimal relationship of corrosion protection and consumption of coating material can be achieved.

The pocket-shaped depressions can be introduced into the surface by means of laser beam treatment, for example.

Exemplary embodiments of the present invention will be described in greater detail below.

The inner surface of a cylinder liner composed of a commercially available cast-iron material is worked according to the invention. For this purpose, inner drilling by means of a drilling tool takes place first, in known manner. In this connection, the inside diameter is adjusted to a defined dimension, a defined cylindricity, and a defined roughness. In this way, the inner surface of the cylinder liner is prepared for the subsequent method steps.

In the subsequent method step, the inner surface of the cylinder liner is worked by means of rough honing, using a honing tool, whereby the honing stones of the honing tool remove material from the inner surface of the cylinder liner. In this connection, the precision of the inside diameter is improved in terms of dimension, cylindricity, and roughness. At the same time, defined depressions ("honing grooves") are introduced into the inner surface of the cylinder liner. The number of depressions, their depth, and their distribution on the inner surface of the cylinder liner can be determined by means of the selection of the grain size of the honing stones, in known manner.

Subsequent to the rough honing, the inner surface of the cylinder liner is coated with a zinc varnish by means of spray application. In this connection, the depressions introduced by the honing tool are filled with the zinc varnish.

After the zinc varnish has hardened, base honing takes place in the next method step. In this connection, the zinc varnish outside of the depressions is removed over the full area, until the material of the cylinder liner has been reached. In the end result, only the zinc varnish that has collected in the depressions remains in the region of the inner surface of the cylinder liner. A defined area proportion of the zinc varnish is adjusted by means of the selection of the grain size of the honing stones and of the amount of the removed material of the cylinder liner. At the same time, the roughness of the inner surface is reduced, and the cylindricity is improved.

In a final method step, plateau honing takes place in known manner, from which plateau-like leveling of the surface structure of the inner surface of the cylinder liner results, as a function of the selected grain size of the honing stones and of the amount of the material removal. Furthermore, the final desired surface proportion of the zinc varnish is adjusted, and the cylindricity is optimized.

The parameters of this working of the inner surface of a cylinder liner, as an example, can be found in Table 1.

TABLE 1

| Parameter | Inner drilling | Rough honing | Coating | Base honing | Plateau honing |
|---|---|---|---|---|---|
| Material removal, radial [μm] | 500 | 200 | — | 50 | 3 |
| Cylindricity [μm] | 140 | 12 | — | 10 | 8 |
| Coating, area proportion [%] | — | — | 100 | 15 | 10 |
| Roughness Rz [μm] | 45 | 35 | 10 | 5 | 3 |

In a further exemplary embodiment, an inner surface composed of a cast-iron material is worked as described above. As the single difference, a further surface treatment by means of laser beams takes place after the rough honing and before the coating process, to introduce additional pocket-shaped depressions into the honed inner surface of the cylinder liner.

The parameters of this working of the inner surface of a cylinder liner, as an example, can be seen in Table 2.

TABLE 2

| Parameter | Inner drilling | Rough honing | Laser treatment | Coating | Base honing | Plateau honing |
|---|---|---|---|---|---|---|
| Material removal, radial [μm] | 500 | 200 | — | — | 50 | 3 |
| Cylindricity [μm] | 140 | 12 | — | — | 10 | 8 |
| Coating, area proportion [%] | — | — | — | 100 | 10.5 | 10 |
| Roughness Rz [μm] | 45 | 35 | 100 | 10 | 5 | 3 |

The invention claimed is:

1. A method for the production of a cylinder working surface for a cylinder crankcase housing of an internal combustion engine in which the working surface is protected from corrosion via a cathodic protective effect, comprising the following method steps:

(a) pre-honing of the inner surface of a cylinder liner composed of a cast iron material, with the formation of depressions in the surface using a honing tool having honing stones;

(b) application of a zinc-containing coating material onto the pre-honed surface;

(c) finish-honing of the coated surface, in such a manner that the zinc-containing coating remains only in the depressions formed by means of the pro-honing, such that the remaining zinc coating material forms a cathodic protective effect against corrosive attack on said cast-iron material.

2. The method according to claim 1, wherein in step (b), the pre-honed surface is coated with a zinc film.

3. The method according to claim 1, wherein in step (b), a zinc varnish on an inorganic basis is used.

4. The method according to claim 1, wherein in step (b), the zinc-containing coating is applied by means of a scraping method.

5. The method according to claim 1, wherein in step (b), the coating material is applied by means of thermal spraying, by means of cold-gas spraying, or by means of vacuum suction blasting, using a zinc-containing wire or a zinc-containing powder.

6. The method according to claim 1, wherein between step (a) and step (b), pocket-shaped depressions are introduced into the pre-honed surface.

7. The method according to claim 6, wherein the pocket-shaped depressions cover 2% to 10% of an area of the surface.

8. The method according to claim 6, wherein the pocket-shaped depressions are introduced into the surface using a laser beam method.

9. The method according to claim 6, wherein the pocket-shaped depressions are introduced into the surface with a diameter of 30 μm to 50 μm.

10. The method according to claim 6, wherein the pocket-shaped depressions are introduced into the surface with a maximal depth of 100 μm.

11. Cylinder liner composed of a cast-iron material, for a cylinder crankcase of an internal combustion engine, which can be produced by means of a method according to claim 1.

* * * * *